US009515379B2

(12) United States Patent
Alexopoulos et al.

(10) Patent No.: US 9,515,379 B2
(45) Date of Patent: Dec. 6, 2016

(54) POLY SPIRAL ANTENNA AND APPLICATIONS THEREOF

(71) Applicant: BROADCOM CORPORATION, Irvine, CA (US)

(72) Inventors: Nicolaos Georgiou Alexopoulos, Irvine, CA (US); Seunghwan Yoon, Irvine, CA (US); Alfred Grau Besoli, Barcelona (ES)

(73) Assignee: BROADCOM CORPORATION, Irvine, CA (US)

( * ) Notice: Subject to any disclaimer, the term of this patent is extended or adjusted under 35 U.S.C. 154(b) by 580 days.

(21) Appl. No.: 14/042,444

(22) Filed: Sep. 30, 2013

(65) Prior Publication Data

US 2015/0070215 A1 Mar. 12, 2015

Related U.S. Application Data

(60) Provisional application No. 61/876,481, filed on Sep. 11, 2013.

(51) Int. Cl.

| | |
|---|---|
| ***H01Q 7/00*** | (2006.01) |
| ***H01Q 25/00*** | (2006.01) |
| ***H01Q 3/26*** | (2006.01) |
| ***H01Q 9/27*** | (2006.01) |
| ***H01Q 21/28*** | (2006.01) |

(52) U.S. Cl.

CPC ..... *H01Q 3/26* (2013.01); *H01Q 9/27* (2013.01); *H01Q 21/28* (2013.01)

(58) Field of Classification Search

CPC ..... H01Q 3/26; H01Q 7/00; H01Q 25/00; H01Q 9/27; H01Q 21/28

See application file for complete search history.

(56) References Cited

U.S. PATENT DOCUMENTS

| | | | | |
|---|---|---|---|---|
| 6,452,568 | B1 * | 9/2002 | Zidek | H01Q 1/36 343/700 MS |
| 7,639,183 | B2 * | 12/2009 | Teshirogi | H01Q 1/3233 343/700 MS |
| 2013/0012144 | A1 * | 1/2013 | Besoli | H01Q 1/36 455/85 |

* cited by examiner

*Primary Examiner* — Hoang V Nguyen
(74) *Attorney, Agent, or Firm* — Garlick & Markison; Bruce E. Garlick

(57) ABSTRACT

A poly spiral antenna includes spiral antenna sections and interconnecting traces. A first spiral antenna section has a first interwoven spiral pattern and a first excitation configuration to provide a first radiation pattern component. A second spiral antenna section has a second interwoven spiral pattern and a second excitation configuration to provide a second radiation pattern component. A third spiral antenna section has a third interwoven spiral pattern and a third excitation configuration to provide a third radiation pattern component. The interconnecting traces couple the first, second, and third spiral antenna sections together such that the first, second, and third radiation pattern components form a radiation pattern of the poly spiral antenna.

20 Claims, 10 Drawing Sheets

POLY SPIRAL ANTENNA AND APPLICATIONS THEREOF

CROSS REFERENCE TO RELATED PATENTS

The present U.S. Utility patent application claims priority pursuant to 35 U.S.C. §119(e) to the following U.S. Provisional patent application which is hereby incorporated herein by reference in its entirety and made part of the present U.S. Utility patent application for all purposes:

1. U.S. Provisional Application Ser. No. 61/876,481, entitled "POLY SPIRAL ANTENNA AND APPLICATIONS THEREOF," filed Sep. 11, 2013.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND

Technical Field

This invention relates generally to wireless communication systems and more particularly to antenna structures used in such wireless communication systems.

Description of Related Art

Communication systems are known to support wireless and wire lined communications between wireless and/or wire lined communication devices. Such communication systems range from national and/or international cellular telephone systems to the Internet to point-to-point in-home wireless networks to radio frequency identification (RFID) systems to radio frequency radar systems. Each type of communication system is constructed, and hence operates, in accordance with one or more communication standards. For instance, radio frequency (RF) wireless communication systems may operate in accordance with one or more standards including, but not limited to, RFID, IEEE 802.11, Bluetooth, global system for mobile communications (GSM), code division multiple access (CDMA), WCDMA, local multi-point distribution systems (LMDS), multi-channel-multi-point distribution systems (MMDS), LTE, WiMAX, and/or variations thereof. As another example, infrared (IR) communication systems may operate in accordance with one or more standards including, but not limited to, IrDA (Infrared Data Association).

For an RF wireless communication device to participate in wireless communications, it includes a built-in radio transceiver (i.e., receiver and transmitter) or is coupled to an associated radio transceiver (e.g., a station for in-home and/or in-building wireless communication networks, RF modem, etc.). The receiver is coupled to the antenna and includes a low noise amplifier, one or more intermediate frequency stages, a filtering stage, and a data recovery stage. The transmitter includes a data modulation stage, one or more intermediate frequency stages, and a power amplifier, which is coupled to the antenna.

Since a wireless communication begins and ends with the antenna, a properly designed antenna structure is an important component of wireless communication devices. As is known, the antenna structure is designed to have a desired impedance (e.g., 50 Ohms) at an operating frequency, a desired bandwidth centered at the desired operating frequency, and a desired length (e.g., ¼ wavelength of the operating frequency for a monopole antenna). As is further known, the antenna structure may include a single monopole or dipole antenna, a diversity antenna structure, an antenna array having the same polarization, an antenna array having different polarization, and/or any number of other electromagnetic properties.

Two-dimensional antennas are known to include a meandering pattern or a micro strip configuration. For efficient antenna operation, the length of an antenna should be ¼ wavelength for a monopole antenna and ½ wavelength for a dipole antenna, where the wavelength ($\lambda$)=c/f, where c is the speed of light and f is frequency. For example, a ¼ wavelength antenna at 900 MHz has a total length of approximately 8.3 centimeters (i.e., $0.25*(3\times10^8$ m/s)/($900\times10^6$ c/s)=0.25*33 cm, where m/s is meters per second and c/s is cycles per second). As another example, a ¼ wavelength antenna at 2400 MHz has a total length of approximately 3.1 cm (i.e., $0.25*(3\times10^8$ m/s)/($2.4\times10^9$ c/s)=0.25*12.5 cm).

While two-dimensional antennas provide reasonable antenna performance for many wireless communication devices, there are issues when the wireless communication devices require full duplex operation and/or multiple input and/or multiple output (e.g., single input multiple output, multiple input multiple output, multiple input single output) operation. For instance, antenna arrays and other antenna structures use antennas with the same radiation pattern and bandwidth.

BRIEF DESCRIPTION OF THE SEVERAL VIEWS OF THE DRAWING(S)

DETAILED DESCRIPTION

Figure 1:
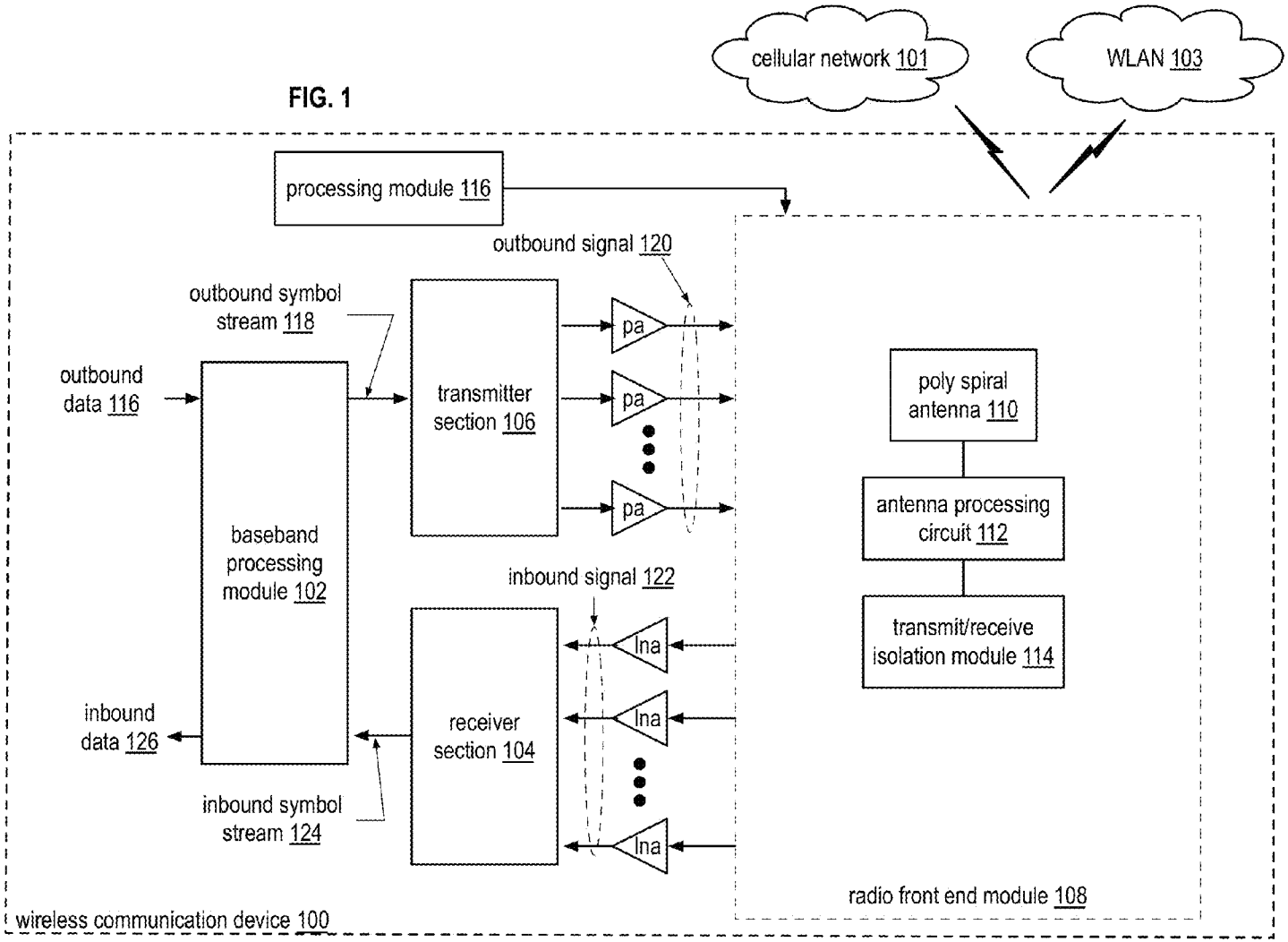
FIG. 1 is a schematic block diagram of an embodiment of a wireless communication device in accordance with the present disclosure.

FIG. 1 is a schematic block diagram of an embodiment of a wireless communication device 100 that may be any device that can be carried by a person, can be at least partially powered by a battery, includes a radio transceiver (e.g., radio frequency (RF) and/or millimeter wave (MMW)) and performs one or more software applications. For example, the wireless communication device 100 may be a cellular telephone, a laptop computer, a personal digital assistant, a video game console, a video game player, a personal entertainment unit, a tablet computer, etc. The wireless communication device 100 may communicate via the cellular network 101 and/or the wireless local area network (WLAN) network 103 in accordance with one or more cellular and/or WLAN protocols.

The wireless communication device 100 includes a baseband processing module 102, a receiver section 104, a plurality of low noise amplifiers, a transmitter section 106, a plurality of power amplifiers, a processing module 115, and radio front-end module 108. The radio front-end module 108 includes one or more poly spiral antennas 110, an antenna processing circuit 112, and a transmit/receive isolation module 114. Each of the one or more poly spiral antennas 110 includes a plurality of spiral antenna sections, where at least two of the spiral antenna sections have differing radiation patterns. In addition, the spiral antenna sections have overlapping bandwidths such that channels of interest (e.g., carrier frequencies of one or more wireless communication protocols) are within the overlapping bandwidths.

In an example of transmitting an outbound signal 120, the baseband processing module 102 converts outbound data 116 (e.g., voice, text, audio, video, graphics, etc.) into one or more outbound symbol streams 118 in accordance with one or more wireless communication standards (e.g., GSM, CDMA, WCDMA, HSUPA, HSDPA, WiMAX, EDGE, GPRS, IEEE 802.11, Bluetooth, ZigBee, universal mobile telecommunications system (UMTS), long term evolution (LTE), IEEE 802.16, evolution data optimized (EV-DO), etc.). Such a conversion includes one or more of: scrambling, puncturing, encoding, interleaving, constellation mapping, modulation, frequency spreading, frequency hopping, beamforming, space-time-block encoding, space-frequency-block encoding, frequency to time domain conversion, and/or digital baseband to intermediate frequency conversion. Note that the baseband processing module 102 converts the outbound data 116 into a single outbound symbol stream 118 for Single Input Single Output (SISO) communications and/or for Multiple Input Single Output (MISO) communications and converts the outbound data 116 into multiple outbound symbol streams 118 for Single Input Multiple Output (SIMO) and Multiple Input Multiple Output (MIMO) communications.

The baseband processing module 102 provides the outbound symbol stream(s) 118 to an up conversion circuit of the transmit section 106, which converts the outbound symbol stream(s) 118 into one or more up converted signals (e.g., signals in one or more frequency bands 800 MHz, 1800 MHz, 1900 MHz, 2000 MHz, 2.4 GHz, 5 GHz, 60 GHz, etc.). The up conversion circuit may have a direct conversion topology or a super-heterodyne topology and may include discrete digital components and/or analog circuitry. In addition, the up conversion circuit may receive and process the outbound symbol stream(s) 118 as Cartesian coordinates, as polar coordinates, and/or as hybrid polar-Cartesian coordinates.

A transmit (TX) output circuit of the transmitter section 106 receives the one or more up converted signals and provides them to one or more of the power amplifiers (pa). The transmit output circuit may include a splitter for providing an up converted signal to multiple power amplifiers such that, when the signals are transmitted, they are combined in air, which increases the transmit power. In this manner, one or more of the expensive discrete components (e.g., surface acoustic wave (SAW) filters, off-chip power amplifiers, duplexers, inductors, and/or capacitors) may be omitted. In addition, or in the alternative, the transmit output circuit may include one or more phase shift circuits to phase shift the one or more up converted signals to facilitate beamforming. The transmit output circuit may further include, or include in the alternative, a polar coordinate drive to facilitate polar coordinate outbound signals.

Regardless of the specific implementation of the transmit output circuit, one or more power amplifiers receives the up-converted signal(s) and amplifies them to produce outbound signal(s) 120. The power amplifier(s) provide the outbound signal(s) 120 to the transmit/receive isolation module 114. The transmit/receive isolation module 114 may be a duplexer, circulator, transformer, etc. that provides isolation (e.g., 20 dB or more) between the outbound signal 120 and an inbound signal 122. For an outbound signal 120, the antenna processing circuit 110 provides components of the outbound signal to the poly spiral antenna sections of the poly spiral antenna 110 for transmission. For example, the components of the outbound signal may be created by the transmit output circuit or the antenna processing circuit may produce them from the outbound signal 120.

In an example of receiving an inbound signal 122, the poly spiral antenna sections of the poly spiral antenna 110 receive respective components of the inbound signal 122 and provide them to the antenna processing circuit 112. The antenna processing circuit 112 provides the components of the inbound signal 122 to one or more low noise amplifiers via the transmit/receive isolation module 114.

The low noise amplifiers amplify the inbound signal components to produce amplified inbound signal(s). The low noise amplifier(s) provide the amplified inbound signal components to a receive (RX) input circuit of the receiver section 104, which is a complimentary circuit to the transmit output circuit of the transmitter section. For instance, if the transmit output circuit includes a splitter, the receive input circuit includes a combiner to combine the components into the inbound signal 122.

Alternatively, the antenna processing circuit combines the components into one or more inbound signals 122 that are provided to one or more of the low noise amplifiers via one or more transmit/receive isolation modules 114. The low noise amplifier(s) amplifies the one or more inbound signals 122 and provides them to the receive input circuit of the receiver section 104.

The receive input circuit provides the inbound signal to a down conversion circuit of the receiver section, which converts the inbound signal into one or more inbound symbol streams 124. The down conversion circuit may have a direct conversion topology or a super-heterodyne topology and may include discrete digital components and/or analog circuitry. In addition, the down conversion circuit may receive and process the inbound signals as Cartesian coordinates, as polar coordinates, and/or as hybrid polar-Cartesian coordinates.

The baseband processing module 102 converts the inbound symbol stream(s) 124 into inbound data 126 (e.g., voice, text, audio, video, graphics, etc.) in accordance with one or more wireless communication standards. Such a conversion may include one or more of: digital intermediate frequency to baseband conversion, time to frequency domain conversion, space-time-block decoding, space-frequency-block decoding, demodulation, frequency spread decoding, frequency hopping decoding, beamforming decoding, constellation demapping, deinterleaving, decoding, depuncturing, and/or descrambling. Note that the baseband processing module 102 converts a single inbound symbol stream 124 into the inbound data 126 for Single Input Single Output (SISO) communications and/or for Multiple Input Single Output (MISO) communications and converts multiple inbound symbol streams 124 into the inbound data 126 for Single Input Multiple Output (SIMO) and Multiple Input Multiple Output (MIMO) communications.

The wireless communication device 100 may be implemented using one or more integrated circuits (IC) and one or more substrates (e.g., printed circuit boards), where an IC includes one or more IC dies and an IC package substrate. For example, the antenna processing circuit 110, the power amplifiers, and the low noise amplifiers may be implemented on the one or more IC dies and the poly spiral antenna 110 on an IC package substrate and/or one of the substrates. As another example, one or more of the baseband processing module 102, the receiver section 104, the transmitter section 106, and the processing module 114 may also be implemented on the one or more IC dies.

Figure 2:
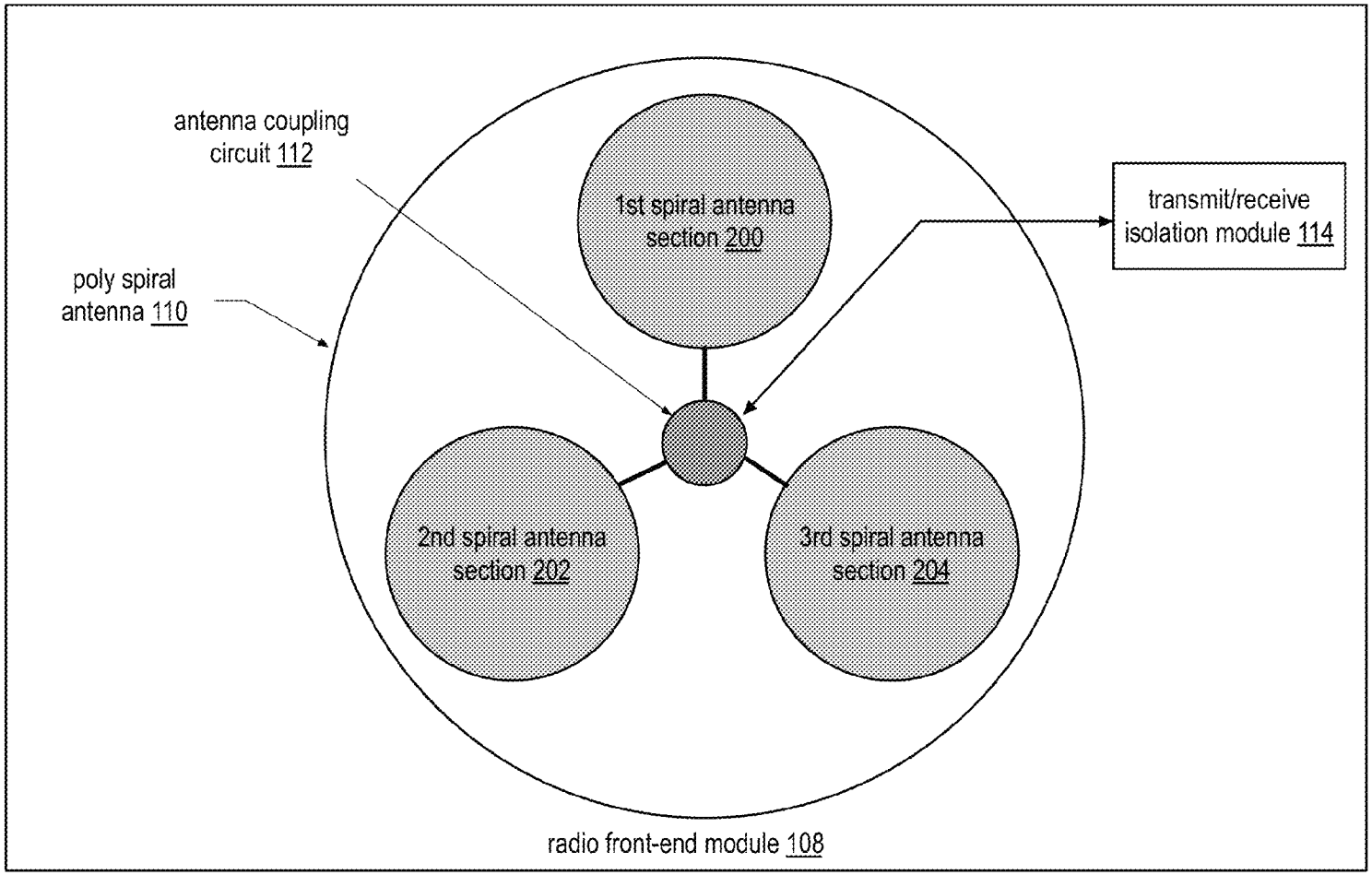
FIG. 2 is a schematic block diagram of an embodiment of a radio front-end module in accordance with the present disclosure.

FIG. 2 is a schematic block diagram of an embodiment of a radio front-end module 108 that includes one or more poly spiral antennas 110, an antenna processing circuit 112, and a transmit/receive isolation module 114. Each of the one or more poly spiral antennas 110 includes a plurality of spiral antenna sections. For example, a poly spiral antenna 110 includes a first spiral section 200, a second spiral section 202, and a third spiral section 204.

The first spiral antenna section 200 has a first interwoven spiral pattern and a first excitation configuration to provide a first radiation pattern component. The second spiral antenna section 202 has a second interwoven spiral pattern and a second excitation configuration to provide a second radiation pattern component. The third spiral antenna section 204 has a third interwoven spiral pattern and a third excitation configuration to provide a third radiation pattern component. The spiral antenna sections 200-204 are coupled together via interconnecting traces, which are of a length to maintain a desired current at ends of the individual spiral antenna sections. For example, assume that each spiral antenna section has an effective length of one-half wavelength such that the current at the end of the spiral section is essentially zero. In this example, the length of an interconnecting trace would be one-half wavelength (or a multiple thereof) to connect two spiral antenna sections together with an effective inverting path of the signal.

Figure 3:
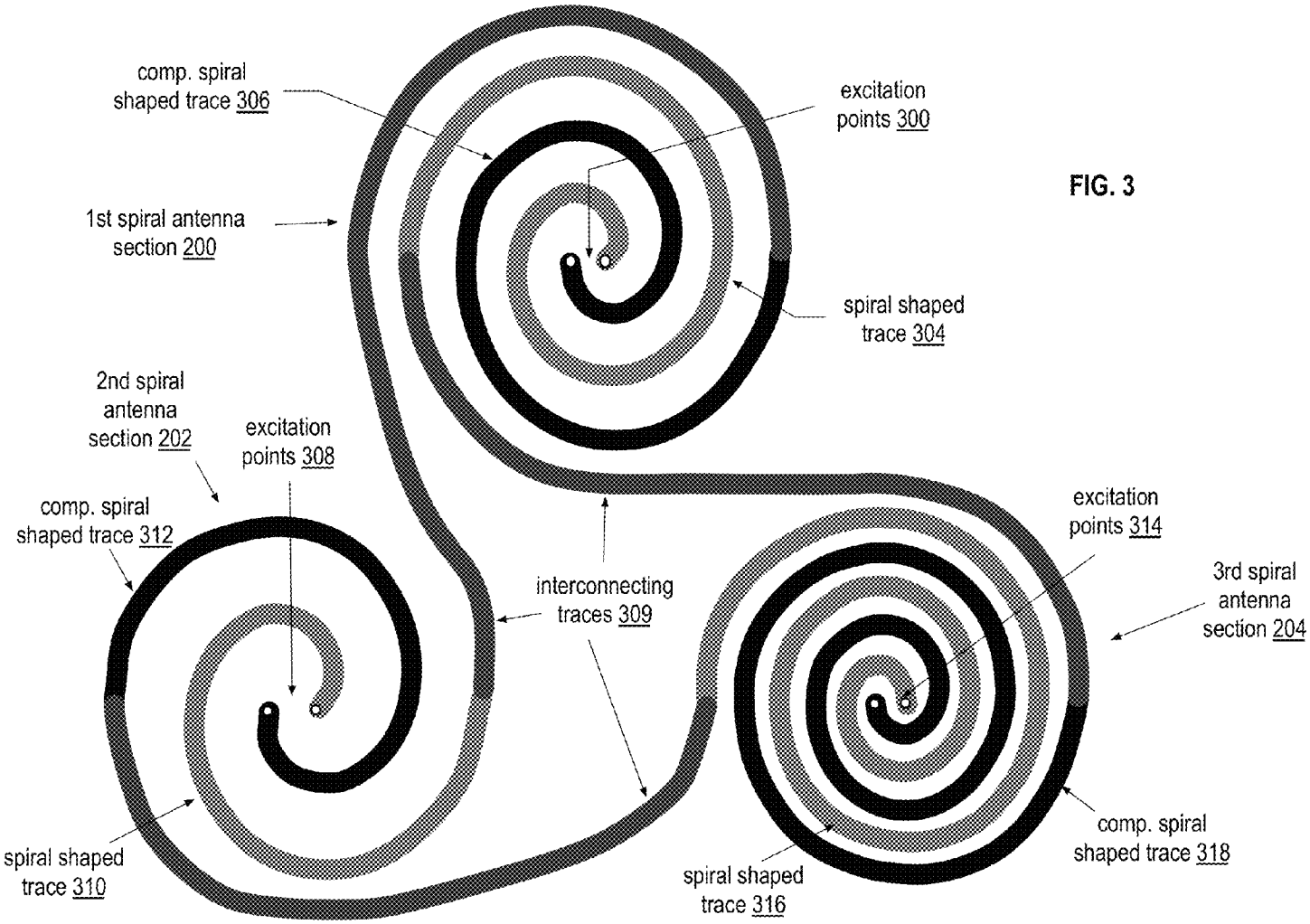
FIG. 3 is a schematic block diagram of an embodiment of a poly spiral antenna in accordance with the present disclosure.

FIG. 3 is a schematic block diagram of an embodiment of a poly spiral antenna 110 that includes a first spiral section 200, a second spiral section 202, a third spiral section 204, and interconnection traces 309. The first spiral section 200 includes a first spiral shaped trace 304 and a first complimentary interwoven spiral shaped trace 306. The first spiral shaped trace 304 and the first complimentary interwoven spiral shaped trace 306 have a first number of turns (e.g., 2) and, collectively, have a first circumference (e.g., 10-200 mm). The first excitation configuration includes two excitation points 300 that are separated by a first distance (e.g., 0.1-15 mm).

The second spiral section 202 includes a second spiral shaped trace 310 and a second complimentary interwoven spiral shaped trace 312. The second spiral shaped trace 310 and the second complimentary interwoven spiral shaped trace 312 have a second number of turns (e.g., 1) and collectively have the first circumference (e.g., substantially the same circumference as the first spiral section). The second excitation configuration includes two excitation points 308 that are separated by the first distance (e.g., substantially the same distance as the excitation points of the first spiral section).

The third spiral section 204 includes a third spiral shaped trace 316 and a third complimentary interwoven spiral shaped trace 318. The third spiral shaped trace 316 and the third complimentary interwoven spiral shaped trace 318 have a third number of turns (e.g., 4) and collectively have the first circumference (e.g., substantially the same circumference as the first and second spiral sections). The third excitation configuration includes two excitation points 314 that are separated by the first distance (e.g., substantially the same distance as the excitation points of the first and second spiral sections).

Each of the excitation points 300, 308, and 314 are coupled to the antenna processing circuit 110 and, for an outbound signal, receive a corresponding component of the outbound signal. For example, the first excitation points 308 are fed with a zero degree phase shifted representation of the outbound signal, the second excitation points 308 are fed with a 120 degree phase shifted representation of the outbound signal, and the third excitation points 308 are fed with a 240 degree phase shifted representation of the outbound signal. The length of the interconnection tracings 309 is ⅓ of the wavelength of the carrier frequency of the signals being transmitted.

For an inbound signal, each of the spiral antenna sections 200-204 receives the inbound signal. The excitation points of each spiral antenna section output a component of the inbound signal. For example, the first excitation points 308 outputs a zero degree phase shifted representation of the inbound signal, the second excitation points 308 outputs a 120 degree phase shifted representation of the inbound signal, and the third excitation points 308 output a 240 degree phase shifted representation of the inbound signal.

Operating characteristics of the poly spiral antenna 110 are based on the physical properties of the spiral antenna sections 200-204. For instance, the circumference of the spiral antenna sections is a factor for a lower frequency cutoff of a frequency band of operation of the poly spiral antenna. Further, distance of the excitation region (e.g., distance between excitation points and/or radius of an inner most turn) is a factor of an upper frequency cutoff of the frequency band of operation. Still further, the first, second, and third interwoven spiral patterns invert an opposite radiation lobe of the antenna to approximately double the gain of the poly spiral antenna. Even further, the first, second, and third number of turns provides different circular polarization radiation patterns, which collectively form a more diverse radiation pattern for the poly spiral antenna.

Yet further, the trace width, distance between traces, length of each spiral section, distance to a ground plane, and/or use of an artificial magnetic conductor plane affect the quality factor, radiation pattern, impedance (which is fairly constant over the bandwidth), gain, and/or other characteristics of each of the spiral antenna sections 200-204.

In a specific example, assume that each spiral antenna section has a 20 mm radius, which equates to a 125.66 mm circumference (e.g., $2*\pi*20=125.66$ mm circumference). Such a circumference corresponds to a low frequency cutoff of approximately 2 GHz. Further assume that the excitation region of each spiral antenna section has a distance of approximately 5 mm, which establishes a high frequency cutoff of approximately 8 GHz. As such, each spiral antenna section has a bandwidth of 2-8 GHz, centered at 5 GHz.

The geometric shape of each of the spiral antenna sections 200-204 may be circular as shown or may be different geometric shapes. For example, each spiral antenna section may have a geometric shape of an elliptical spiral, a triangular-shaped spiral, a square-shaped spiral, a rectangular-shaped spiral, and/or a poly-sided shaped spiral (e.g., five sides or more). As another example, each spiral antenna section may be have a geometric shape of a circular Celtic spiral, an elliptical Celtic spiral, a circular Archimedean spiral shape, an elliptical Archimedean spiral shape, and/or an equiangular spiral shape.

Figure 4:
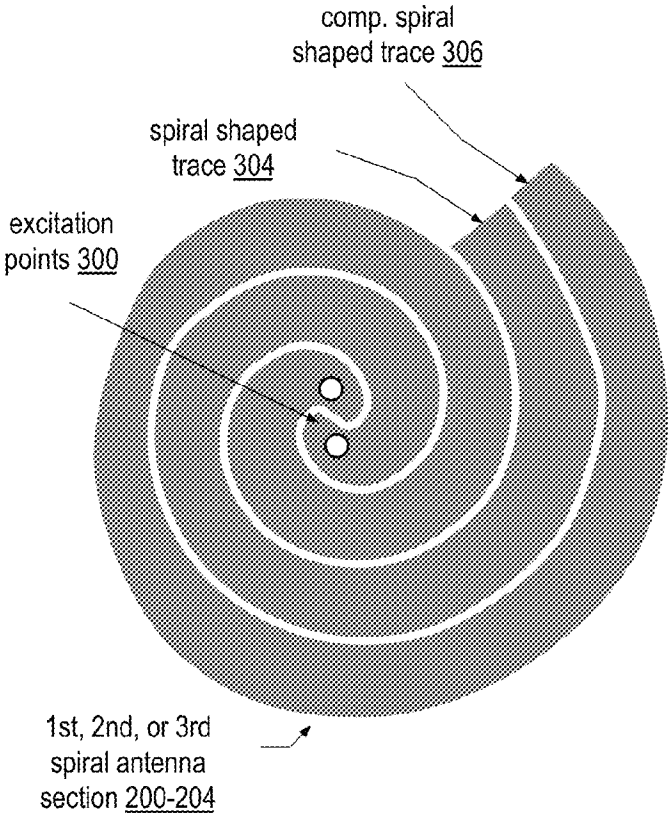
FIG. 4 is a schematic block diagram of an embodiment of an etched spiral for use in a poly spiral antenna in accordance with the present disclosure.

FIG. 4 is a schematic block diagram of an embodiment of an etched spiral for use in a poly spiral antenna. In this embodiment, one or more of the first, second, and third spiral antenna sections 200-204 may have an etched spiral shape as opposed to spiral trace shape. The etched spiral includes excitation points 300, the spiral shaped trace 304 and the complimentary spiral shaped trace 306. In this embodiment, an etching in a metal layer creates a high impedance separation between the spiral shaped trace 304 and the complimentary spiral shaped trace 306.

Figure 5:
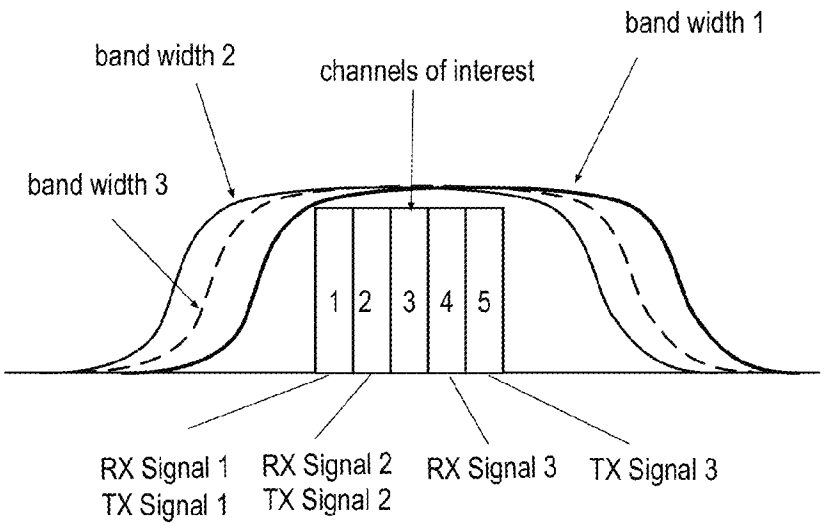
FIG. 5 is a diagram of an example of bandwidths of a poly spiral antenna in accordance with the present disclosure.

FIG. 5 is a diagram of an example of bandwidths of a poly spiral antenna. Each of the spiral antenna sections 200-204 has its own bandwidth (e.g., from the low frequency established by the circumference to the high frequency established by the distance of the excitation region). For example, the first spiral antenna section has a first bandwidth (1), the second spiral antenna section has a second bandwidth (2), and the third spiral antenna section has a third bandwidth (3). The bandwidths overlap channels of interest. The channels of interest 304 may be in one or more of a plurality of frequency bands, such as 850 MHz and 1900 MHz for cellular communication, 2.4 GHz, 3.6 GHz, 5 GHz, and 60 GHz for WLAN communications and/or personal area network communications.

In an example of operation, the poly spiral antenna is configured to support a first communication (RX and TX signal 1), which is conveyed over a first channel. The poly spiral antenna may be further configured to support, concurrently or sequentially, a second communication (RX and TX signal 2), which is conveyed over a second channel. The poly spiral antenna may still further be configured to support, concurrently or sequentially, a third communication has transmit signals (TX signal 3) conveyed over channel 5 and receive signals (RX signal 3) conveyed over channel 4. The first, second, and third communications may be separate communications and/or communication components of a MIMO communication.

Figure 6:
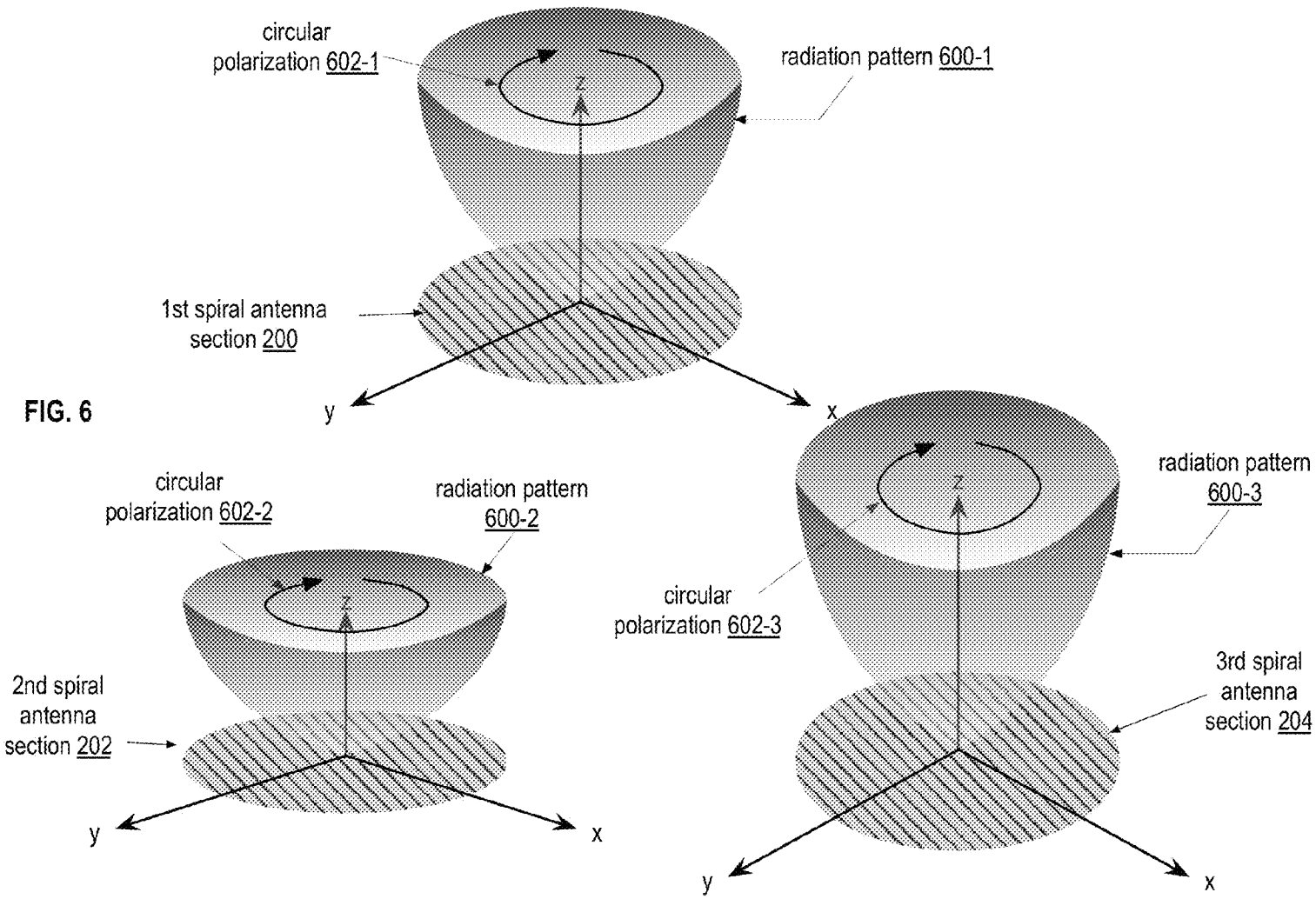
FIG. 6 is a diagram of examples of radiation patterns of spiral antenna sections of a poly spiral antenna in accordance with the present disclosure.

FIG. 6 is a diagram of examples of radiation patterns of spiral antenna sections of a poly spiral antenna 110 of FIG. 3. In this example, the radiation patterns 600-1 through 600-3 of each of the spiral antenna sections 200-204 have a common circular polarization 602-1 through 602-3. In addition, each radiation pattern has a parabolic conical shape with differing heights and/or widths. In this example, the heights correspond to an effective directional transmit and/or reception gain and the width corresponds to the beam width of the radiation pattern of the transmit and/or reception range. As shown, the radiation pattern 600-2 of the second spiral antenna section 202 has less length and/or more breadth than the radiation pattern 600-1 of the first spiral antenna section 200, which has less length and/or more breadth than the radiation pattern 600-3 of the third spiral antenna section 203.

Figure 7:
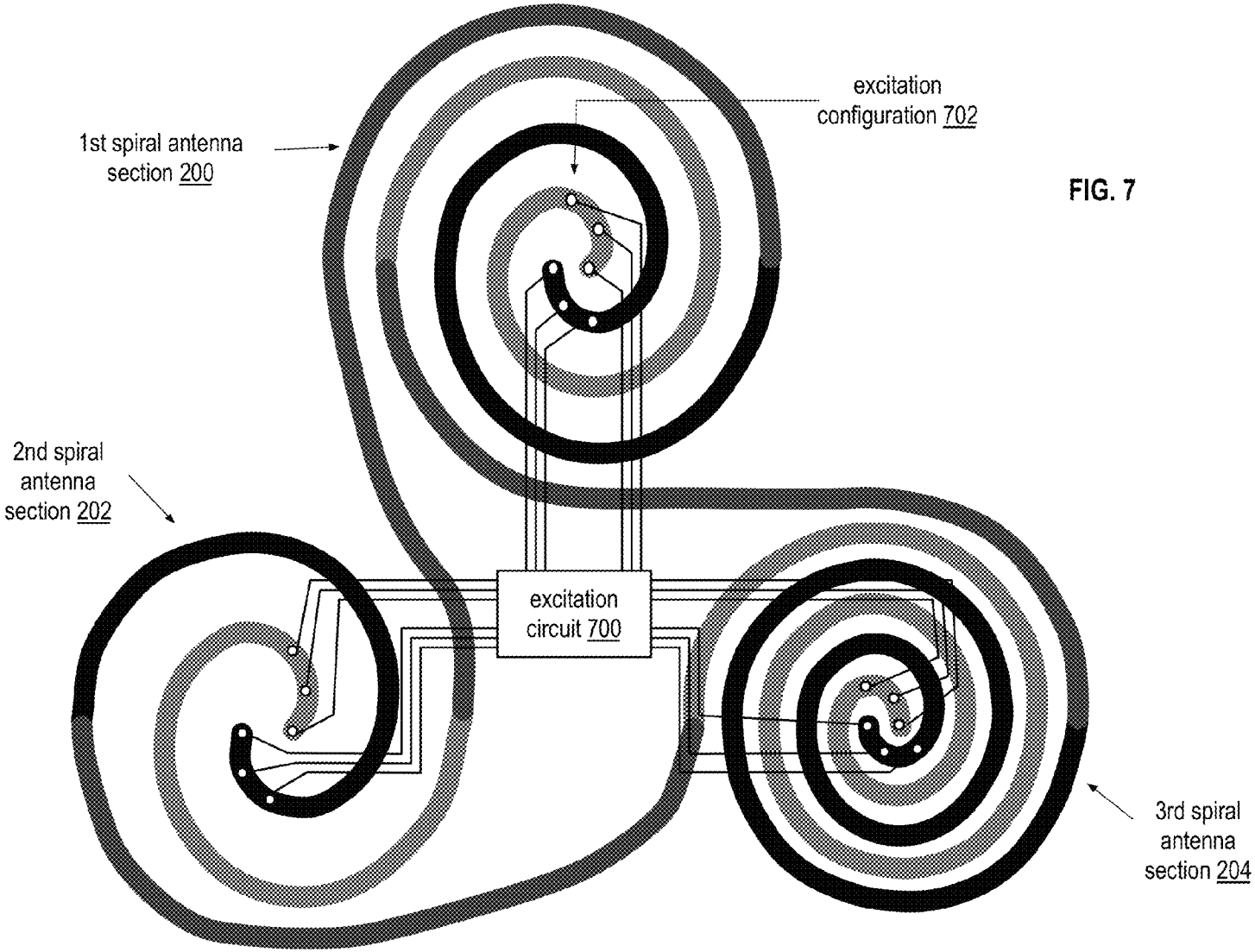
FIG. 7 is a schematic block diagram of an embodiment of a configurable poly spiral antenna in accordance with the present disclosure.

FIG. 7 is a schematic block diagram of an embodiment of a configurable poly spiral antenna 110 that includes the first, second, and third spiral antenna sections 200-204 and an excitation circuit 700. Each of the first, second, and third spiral antenna sections 200-204 includes an excitation configuration 702 that includes multiple excitation points coupled to the excitation circuit 700. The excitation points are spaced such that reflected current inwards is negligible for various frequencies of signals being transceived.

The excitation circuit 700 selectively enables the first, second, and third excitation configurations to adjust the radiation pattern of the poly spiral antenna. For example, the excitation circuit 700 selects a set of excitation points for each of the spiral antenna sections. The inner most pair of excitation points provides a high frequency of the spiral antenna section's bandwidth that is greater than the high frequency of the spiral antenna section's bandwidth provided by the next pair of excitation points, and so on.

Figure 8:
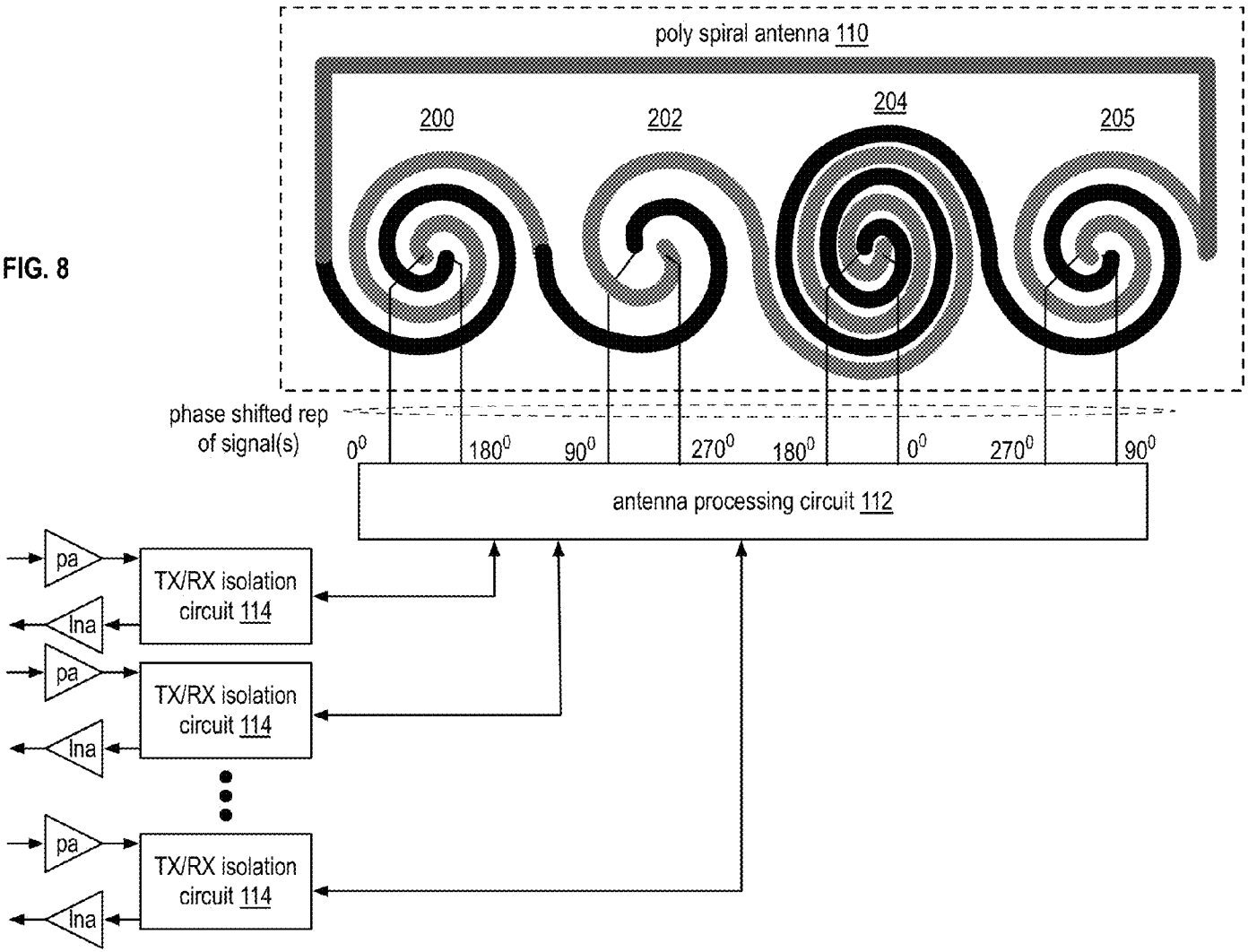
FIG. 8 is a schematic block diagram of an embodiment of a configurable radio front-end module in accordance with the present disclosure.

FIG. 8 is a schematic block diagram of an embodiment of a configurable radio front-end module 108 that includes the poly spiral antenna 110, the antenna processing circuit, and one or more transmit/receive isolation modules 114. The poly spiral antenna 110 includes four spiral antenna sections 200-205 and corresponding interconnection traces. Each of the spiral antenna section has a different number of turns or at least some of them have a different number of turns and/or the spiral sections may have differing sizes from one another.

The antenna processing circuit 112 is operable to configure the poly spiral antenna for a variety of operating modes such as power combining, diversity, beamforming, MIMO, and a combination thereof. For example, the antenna processing circuit 112 couples one of the TX/RX isolation circuits 114 to the spiral antenna sections 200-205. In this example, the antenna processing circuit 112 creates 4 differential components of an outbound signal received from the TX/RX isolation circuit 114 and provides a component to each of the spiral antenna sections. In another example, the antenna processing circuit 112 couples each of the spiral antenna sections to different ones of the transmit/receive isolation circuits 114.

Figure 9:
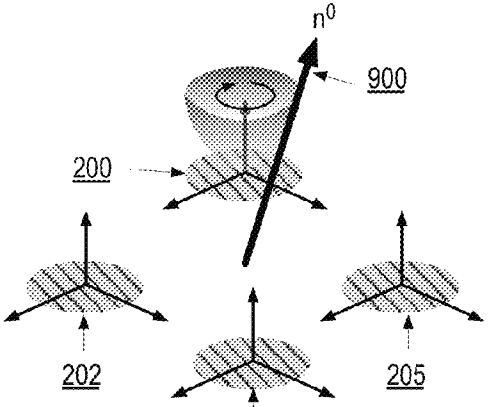
FIG. 9 is a diagram of an example configuration of the configurable radio front-end module in accordance with the present disclosure.
Figure 10:
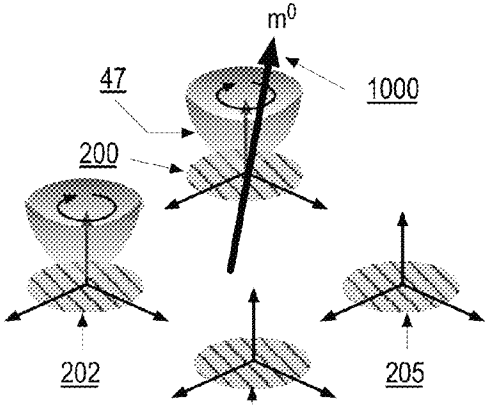
FIG. 10 is a diagram of another example configuration of the configurable radio front-end module in accordance with the present disclosure.
Figure 11:
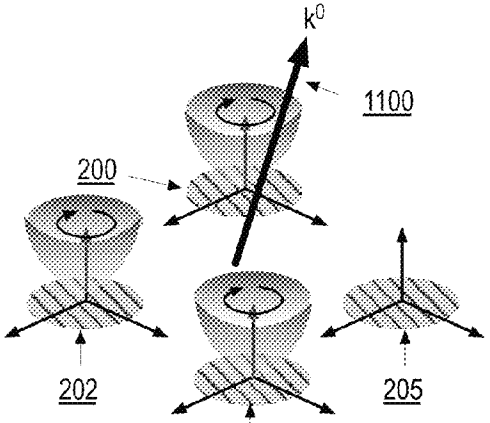
FIG. 11 is a diagram of another example configuration of the configurable radio front-end module in accordance with the present disclosure.
Figure 12:
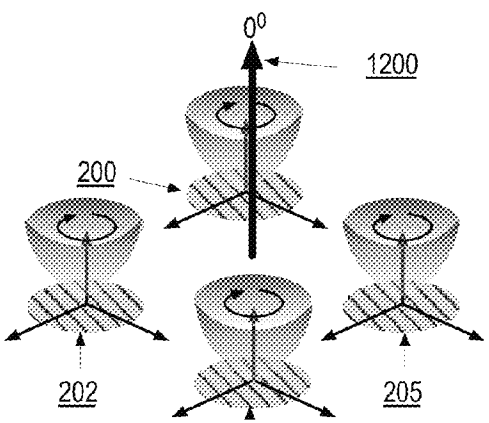
FIG. 12 is a diagram of another example configuration of the configurable radio front-end module in accordance with the present disclosure.

FIGS. 9-12 are diagrams of example poly spiral antenna configurations of the configurable radio front-end module 108 of FIG. 8. As shown in FIG. 9, one spiral antenna section 200 is enabled, which yields a beamformed outbound signal having a beamforming angle 900 of 'n' degrees, where n is greater than or equal to two. As shown in FIG. 10, two spiral antenna sections 200 and 202 are enabled, which yields a beamformed RF signal having a beamforming angle 1000 of 'm' degrees, where m is less than n. As shown in FIG. 11, three spiral antenna sections 200-204 are enabled, which yields a beamformed RF signal having a beamforming angle 1100 of 'k' degrees, where k is less than m. As shown in FIG.

12, four spiral antenna sections 200-205 are enabled, which yields a beamformed RF signal having a beamforming angle 1200 of zero degrees.

Figure 13:
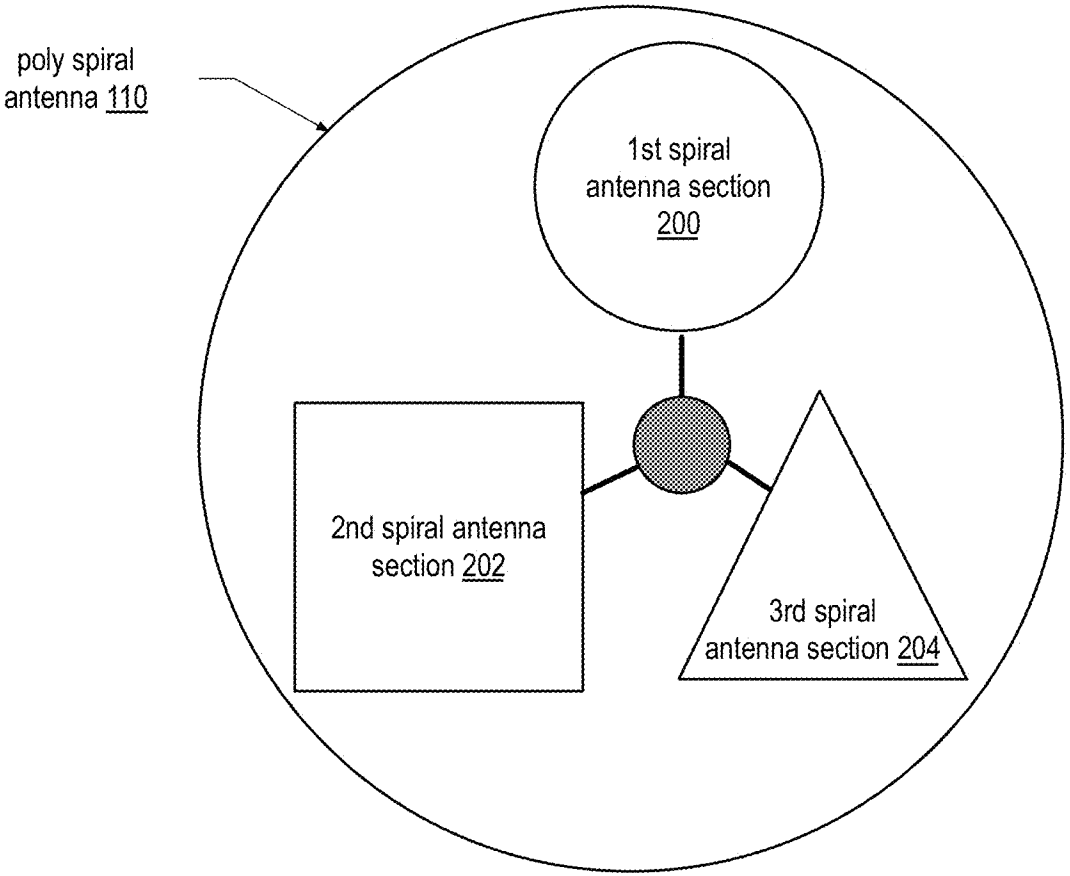
FIG. 13 is a schematic block diagram of another embodiment of a poly spiral antenna in accordance with the present disclosure.

FIG. 13 is a schematic block diagram of another embodiment of a poly spiral antenna 110 that includes the first, second, and third spiral antenna sections 200-204. In this embodiment, each of the spiral antenna sections 200-204 has a different geometric shape (e.g., a circular spiral, an elliptical spiral, a triangular-shaped spiral, a square-shaped spiral, a rectangular-shaped spiral, and a poly-sided shaped spiral). For instance, the first spiral shaped trace and the first complimentary interwoven spiral shaped trace of the first spiral antenna section 200 are of a first geometric shape (e.g., circular); the second spiral shaped trace and the second complimentary interwoven spiral shaped trace of the second spiral antenna section 202 are of a second geometric shape (e.g., square or rectangular); and the third spiral shaped trace and the third complimentary interwoven spiral shaped trace are of the first geometric shape or a third geometric shape (e.g., circular or triangular).

Figure 14:
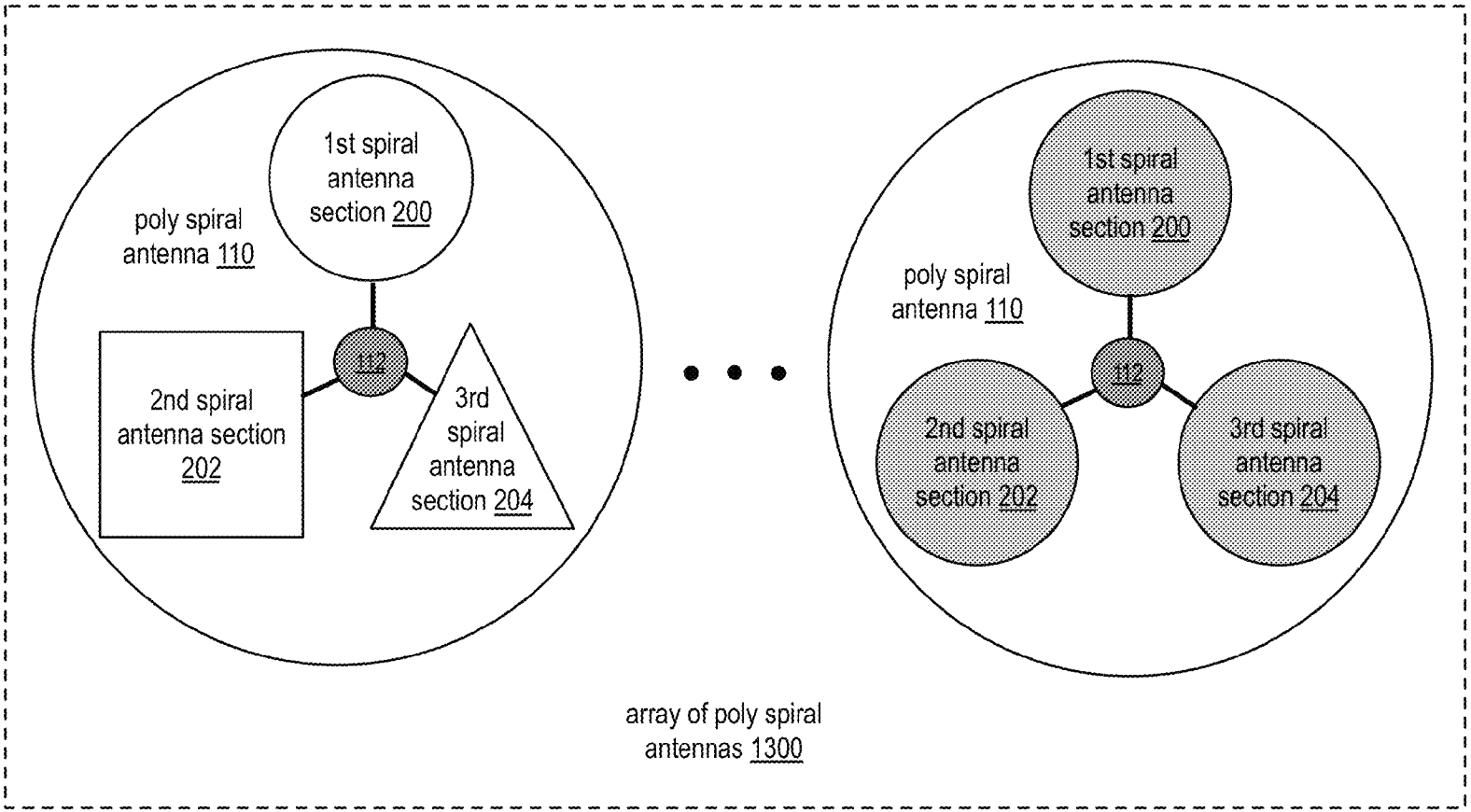
FIG. 14 is a schematic block diagram of an embodiment of an array of poly spiral antennas in accordance with the present disclosure.

FIG. 14 is a schematic block diagram of an embodiment of an array of poly spiral antennas 1300 that includes a plurality of poly spiral antennas 110 and an antenna processing circuit 112, which may be distributed with each poly spiral antenna or a single circuit coupled to each of the poly spiral antennas 110. Each of the poly spiral antennas 110 may have a configuration of spiral antenna sections as previously discussed.

As may be used herein, the terms "substantially" and "approximately" provides an industry-accepted tolerance for its corresponding term and/or relativity between items. Such an industry-accepted tolerance ranges from less than one percent to fifty percent and corresponds to, but is not limited to, component values, integrated circuit process variations, temperature variations, rise and fall times, and/or thermal noise. Such relativity between items ranges from a difference of a few percent to magnitude differences. As may also be used herein, the term(s) "operably coupled to", "coupled to", and/or "coupling" includes direct coupling between items and/or indirect coupling between items via an intervening item (e.g., an item includes, but is not limited to, a component, an element, a circuit, and/or a module) where, for indirect coupling, the intervening item does not modify the information of a signal but may adjust its current level, voltage level, and/or power level. As may further be used herein, inferred coupling (i.e., where one element is coupled to another element by inference) includes direct and indirect coupling between two items in the same manner as "coupled to". As may even further be used herein, the term "operable to" or "operably coupled to" indicates that an item includes one or more of power connections, input(s), output(s), etc., to perform, when activated, one or more its corresponding functions and may further include inferred coupling to one or more other items. As may still further be used herein, the term "associated with", includes direct and/or indirect coupling of separate items and/or one item being embedded within another item. As may be used herein, the term "compares favorably", indicates that a comparison between two or more items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1.

As may also be used herein, the terms "processing module", "processing circuit", and/or "processing unit" may be a single processing device or a plurality of processing devices. Such a processing device may be a microprocessor, micro-controller, digital signal processor, microcomputer, central processing unit, field programmable gate array, programmable logic device, state machine, logic circuitry, analog circuitry, digital circuitry, and/or any device that manipulates signals (analog and/or digital) based on hard coding of the circuitry and/or operational instructions. The processing module, module, processing circuit, and/or processing unit may be, or further include, memory and/or an integrated memory element, which may be a single memory device, a plurality of memory devices, and/or embedded circuitry of another processing module, module, processing circuit, and/or processing unit. Such a memory device may be a read-only memory, random access memory, volatile memory, non-volatile memory, static memory, dynamic memory, flash memory, cache memory, and/or any device that stores digital information. Note that if the processing module, module, processing circuit, and/or processing unit includes more than one processing device, the processing devices may be centrally located (e.g., directly coupled together via a wired and/or wireless bus structure) or may be distributedly located (e.g., cloud computing via indirect coupling via a local area network and/or a wide area network). Further note that if the processing module, module, processing circuit, and/or processing unit implements one or more of its functions via a state machine, analog circuitry, digital circuitry, and/or logic circuitry, the memory and/or memory element storing the corresponding operational instructions may be embedded within, or external to, the circuitry comprising the state machine, analog circuitry, digital circuitry, and/or logic circuitry. Still further note that, the memory element may store, and the processing module, module, processing circuit, and/or processing unit executes, hard coded and/or operational instructions corresponding to at least some of the steps and/or functions illustrated in one or more of the Figures. Such a memory device or memory element can be included in an article of manufacture.

The present invention has been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claimed invention. Further, the boundaries of these functional building blocks have been arbitrarily defined for convenience of description. Alternate boundaries could be defined as long as the certain significant functions are appropriately performed. Similarly, flow diagram blocks may also have been arbitrarily defined herein to illustrate certain significant functionality. To the extent used, the flow diagram block boundaries and sequence could have been defined otherwise and still perform the certain significant functionality. Such alternate definitions of both functional building blocks and flow diagram blocks and sequences are thus within the scope and spirit of the claimed invention. One of average skill in the art will also recognize that the functional building blocks, and other illustrative blocks, modules and components herein, can be implemented as illustrated or by discrete components, application specific integrated circuits, processors executing appropriate software and the like or any combination thereof.

The present invention may have also been described, at least in part, in terms of one or more embodiments. An embodiment of the present invention is used herein to illustrate the present invention, an aspect thereof, a feature thereof, a concept thereof, and/or an example thereof. A physical embodiment of an apparatus, an article of manufacture, a machine, and/or of a process that embodies the present invention may include one or more of the aspects, features, concepts, examples, etc. described with reference to one or more of the embodiments discussed herein. Further, from figure to figure, the embodiments may incorporate the same or similarly named functions, steps, modules, etc. that may use the same or different reference numbers and, as such, the functions, steps, modules, etc. may be the same or similar functions, steps, modules, etc. or different ones.

Unless specifically stated to the contra, signals to, from, and/or between elements in a figure of any of the figures presented herein may be analog or digital, continuous time or discrete time, and single-ended or differential. For instance, if a signal path is shown as a single-ended path, it also represents a differential signal path. Similarly, if a signal path is shown as a differential path, it also represents a single-ended signal path. While one or more particular architectures are described herein, other architectures can likewise be implemented that use one or more data buses not expressly shown, direct connectivity between elements, and/or indirect coupling between other elements as recognized by one of average skill in the art.

The term "module" is used in the description of the various embodiments of the present invention. A module includes a processing module, a functional block, hardware, and/or software stored on memory for performing one or more functions as may be described herein. Note that, if the module is implemented via hardware, the hardware may operate independently and/or in conjunction software and/or firmware. As used herein, a module may contain one or more sub-modules, each of which may be one or more modules.

While particular combinations of various functions and features of the present invention have been expressly described herein, other combinations of these features and functions are likewise possible. The present invention is not limited by the particular examples disclosed herein and expressly incorporates these other combinations.

What is claimed is:

1. A poly spiral antenna comprising:

a first spiral antenna section having a first interwoven spiral pattern and a first excitation configuration to provide a first radiation pattern component;

a second spiral antenna section having a second interwoven spiral pattern and a second excitation configuration to provide a second radiation pattern component;

a third spiral antenna section having a third interwoven spiral pattern and a third excitation configuration to provide a third radiation pattern component;

interconnecting traces coupling the first, second, and third spiral antenna sections together, wherein the first, second, and third radiation pattern components form a radiation pattern of the poly spiral antenna; and an excitation circuit operable to selectively enable the first, second, and third excitation configurations to adjust the radiation pattern of the poly spiral antenna, wherein the selective enabling includes one or more of:

coupling to two different excitation points of a plurality of excitation points of one or more of the first, second, and third excitation configurations; and coupling to one or more of the first, second, and third excitation configurations.

2. The poly spiral antenna of claim 1 further comprising:

the first interwoven spiral pattern including a first spiral shaped trace and a first complimentary interwoven spiral shaped trace, wherein each of the first spiral shaped trace and the first complimentary interwoven spiral shaped trace have a first number of turns, wherein the first interwoven spiral pattern has a first circumference, and wherein the first excitation configuration includes two excitation points that are separated by a first distance;

the second interwoven spiral pattern including a second spiral shaped trace and a second complimentary interwoven spiral shaped trace, wherein each of the second spiral shaped trace and the second complimentary interwoven spiral shaped trace have a second number of turns, wherein the second interwoven spiral pattern has the first circumference, and wherein the second excitation configuration includes two excitation points that are separated by the first distance; and the third interwoven spiral pattern including a third spiral shaped trace and a third complimentary interwoven spiral shaped trace, wherein each of the third spiral shaped trace and the third complimentary interwoven spiral shaped trace have a third number of turns, wherein the third interwoven spiral pattern has the first circumference, and wherein the third excitation configuration includes two excitation points that are separated by the first distance, wherein the first circumference is a factor for a lower frequency cutoff of a frequency band of operation of the poly spiral antenna, the first distance is a factor of an upper frequency cutoff of the frequency band of operation, the first, second, and third interwoven spiral patterns invert an opposite radiation lobe to approximately double gain of the poly spiral antenna, and the first, second, and third number of turns provides different circular polarization radiation patterns.

3. The poly spiral antenna of claim 2 further comprising:

the first spiral shaped trace and the first complimentary interwoven spiral shaped trace are of a first geometric shape;

the second spiral shaped trace and the second complimentary interwoven spiral shaped trace are of the first geometric shape; and the third spiral shaped trace and the third complimentary interwoven spiral shaped trace are of the first geometric shape, wherein the first geometric shape includes one of: a circular spiral, an elliptical spiral, a triangular-shaped spiral, a square-shaped spiral, a rectangular-shaped spiral, and a poly-sided shaped spiral.

4. The poly spiral antenna of claim 2 further comprising:

the first spiral shaped trace and the first complimentary interwoven spiral shaped trace are of a first geometric shape;

the second spiral shaped trace and the second complimentary interwoven spiral shaped trace are of a second geometric shape; and the third spiral shaped trace and the third complimentary interwoven spiral shaped trace are of a third geometric shape, wherein the first, second, and third geometric shapes include a different one of: a circular spiral, an elliptical spiral, a triangular-shaped spiral, a square-shaped spiral, a rectangular-shaped spiral, and a poly-sided shaped spiral.

5. The poly spiral antenna of claim 2 further comprising:

the first spiral shaped trace and the first complimentary interwoven spiral shaped trace are of a first geometric shape;

the second spiral shaped trace and the second complimentary interwoven spiral shaped trace are of a second geometric shape; and the third spiral shaped trace and the third complimentary interwoven spiral shaped trace are of the first geometric shape, wherein the first and second geometric shape include a different one of: a circular spiral, an elliptical spiral, a triangular-shaped spiral, a square-shaped spiral, a rectangular-shaped spiral, and a poly-sided shaped spiral.

6. The poly spiral antenna of claim 1, wherein the first, second, and third interwoven spiral patterns comprise one or more of:

a circular Celtic spiral;

an elliptical Celtic spiral;

a circular Archimedean spiral shape;

an elliptical Archimedean spiral shape; and an equiangular spiral shape.

7. The poly spiral antenna of claim 1, wherein at least one of the first spiral antenna, the second spiral antenna, and the third spiral antenna are formed on a semi-conductive substrate.

8. The poly spiral antenna of claim 1 further comprising:

a fourth spiral antenna section having a fourth interwoven spiral pattern and a fourth excitation configuration to provide a fourth radiation pattern component; and the interconnecting traces further coupling the first, second, third, and fourth spiral antenna sections together, wherein the first, second, third, and fourth radiation pattern components form the radiation pattern of the poly spiral antenna.

9. The poly spiral antenna of claim 1 further comprising:

a substrate that includes one or more layers, wherein the first, second, and third spiral antenna sections are on the one or more layers.

10. An array of poly spiral antennas comprising:

a plurality of poly spiral antennas, wherein a poly spiral antenna of the plurality of poly spiral antennas includes:

a first spiral antenna section having a first interwoven spiral pattern and a first excitation configuration to provide a first radiation pattern component;

a second spiral antenna section having a second interwoven spiral pattern and a second excitation configuration to provide a second radiation pattern component;

a third spiral antenna section having a third interwoven spiral pattern and a third excitation configuration to provide a third radiation pattern component;

interconnecting traces coupling the first, second, and third spiral antenna sections together, wherein the first, second, and third radiation pattern components form a radiation pattern of the poly spiral antenna; and an antenna processing circuit coupled to the plurality of poly spiral antennas, wherein the antenna processing circuit is configured to:

send one or more outbound signals to the plurality of poly spiral antennas; and receive one or more inbound signals from the plurality of poly spiral antennas;

selectively enable the first, second, and third excitation configurations to adjust the radiation pattern of the poly spiral antenna, wherein the selective enabling includes one or more of:

coupling to two different excitation points of a plurality of excitation points of one or more of the first, second, and third excitation configurations; and coupling to one or more of the first, second, and third excitation configurations.

11. The array of poly spiral antennas of claim 10, wherein the antenna processing circuit is further configured to perform at least one of:

coupling to the plurality of poly spiral antennas for multiple input multiple output (MIMO) communications;

coupling to the plurality of poly spiral antennas to provide a diversity antenna; and coupling to the plurality of poly spiral antennas for diversity antennas for MIMO communications.

12. The array of poly spiral antennas of claim 10, wherein the poly spiral antenna further comprising:

the first interwoven spiral pattern including a first spiral shaped trace and a first complimentary interwoven spiral shaped trace, wherein each of the first spiral shaped trace and the first complimentary interwoven spiral shaped trace have a first number of turns, wherein the first interwoven spiral pattern has a first circumference, and wherein the first excitation configuration includes two excitation points that are separated by a first distance;

the second interwoven spiral pattern including a second spiral shaped trace and a second complimentary interwoven spiral shaped trace, wherein each of the second spiral shaped trace and the second complimentary interwoven spiral shaped trace have a second number of turns, wherein the second interwoven spiral pattern has the first circumference, and wherein the second excitation configuration includes two excitation points that are separated by the first distance; and the third interwoven spiral pattern including a third spiral shaped trace and a third complimentary interwoven spiral shaped trace, wherein each of the third spiral shaped trace and the third complimentary interwoven spiral shaped trace have a third number of turns, wherein the third interwoven spiral pattern has the first circumference, and wherein the third excitation configuration includes two excitation points that are separated by the first distance, wherein the first circumference is a factor for a lower frequency cutoff of a frequency band of operation of the poly spiral antenna, the first distance is a factor of an upper frequency cutoff of the frequency band of operation, the first, second, and third interwoven spiral patterns invert an opposite radiation lobe to approximately double gain of the poly spiral antenna, and the first, second, and third number of turns provides different circular polarization radiation patterns.

13. The array of poly spiral antennas of claim 12, wherein the poly spiral antenna further comprising:

the first spiral shaped trace and the first complimentary interwoven spiral shaped trace are of a first geometric shape;

the second spiral shaped trace and the second complimentary interwoven spiral shaped trace are of the first geometric shape; and the third spiral shaped trace and the third complimentary interwoven spiral shaped trace are of the first geometric shape, wherein the first geometric shape includes one of: a circular spiral, an elliptical spiral, a triangular-shaped spiral, a square-shaped spiral, a rectangular-shaped spiral, and a poly-sided shaped spiral.

14. The array of poly spiral antennas of claim 12, wherein the poly spiral antenna further comprising:

the first spiral shaped trace and the first complimentary interwoven spiral shaped trace are of a first geometric shape;

the second spiral shaped trace and the second complimentary interwoven spiral shaped trace are of a second geometric shape; and the third spiral shaped trace and the third complimentary interwoven spiral shaped trace are of a third geometric shape, wherein the first, second, and third geometric shapes include a different one of: a circular spiral, an elliptical spiral, a triangular-shaped spiral, a square-shaped spiral, a rectangular-shaped spiral, and a poly-sided shaped spiral.

15. The array of poly spiral antennas of claim 12, wherein the poly spiral antenna further comprising:

the first spiral shaped trace and the first complimentary interwoven spiral shaped trace are of a first geometric shape;

the second spiral shaped trace and the second complimentary interwoven spiral shaped trace are of a second geometric shape; and the third spiral shaped trace and the third complimentary interwoven spiral shaped trace are of the first geometric shape, wherein the first and second geometric shape include a different one of: a circular spiral, an elliptical spiral, a triangular-shaped spiral, a square-shaped spiral, a rectangular-shaped spiral, and a poly-sided shaped spiral.

16. The array of poly spiral antennas of claim 10, wherein at least one of the first spiral shaped trace, the second spiral shaped trace, and the third spiral shaped trace are formed on a semi-conductive substrate.

17. A radio front-end module comprises:

one or more poly spiral antennas, wherein a poly spiral antenna of the one or more poly spiral antennas includes:

a first spiral antenna section having a first interwoven spiral pattern and a first excitation configuration to provide a first radiation pattern component;

a second spiral antenna section having a second interwoven spiral pattern and a second excitation configuration to provide a second radiation pattern component;

a third spiral antenna section having a third interwoven spiral pattern and a third excitation configuration to provide a third radiation pattern component;

interconnecting traces coupling the first, second, and third spiral antenna sections together, wherein the first, second, and third radiation pattern components form a radiation pattern of the poly spiral antenna; and an antenna processing circuit coupled to the one or more poly spiral antennas, wherein the antenna processing circuit is configured to:

send one or more outbound signals to the one or more poly spiral antennas;

receive one or more inbound signals from the one or poly spiral antennas; and selectively enable the first, second, and third excitation configurations to adjust the radiation pattern of the poly spiral antenna, wherein the selective enabling includes one or more of:

coupling to two different excitation points of a plurality of excitation points of one or more of the first, second, and third excitation configurations; and coupling to one or more of the first, second, and third excitation configurations; and a receive-transmit isolation module operably coupled to the one or more poly spiral antennas, wherein the receive-transmit isolation module is operable to isolate the one or more inbound signals and the one or more outbound signals.

18. The radio front-end module of claim 17, wherein the poly spiral antenna further comprising:

the first interwoven spiral pattern including a first spiral shaped trace and a first complimentary interwoven spiral shaped trace, wherein each of the first spiral shaped trace and the first complimentary interwoven spiral shaped trace have a first number of turns, wherein the first interwoven spiral pattern has a first circumference, and wherein the first excitation configuration includes two excitation points that are separated by a first distance;

the second interwoven spiral pattern including a second spiral shaped trace and a second complimentary interwoven spiral shaped trace, wherein each of the second spiral shaped trace and the second complimentary interwoven spiral shaped trace have a second number of turns, wherein the second interwoven spiral pattern has the first circumference, and wherein the second excitation configuration includes two excitation points that are separated by the first distance; and the third interwoven spiral pattern including a third spiral shaped trace and a third complimentary interwoven spiral shaped trace, wherein each of the third spiral shaped trace and the third complimentary interwoven spiral shaped trace have a third number of turns, wherein the third interwoven spiral pattern has the first circumference, and wherein the third excitation configuration includes two excitation points that are separated by the first distance, wherein the first circumference is a factor for a lower frequency cutoff of a frequency band of operation of the poly spiral antenna, the first distance is a factor of an upper frequency cutoff of the frequency band of operation, the first, second, and third interwoven spiral patterns invert an opposite radiation lobe to approximately double gain of the poly spiral antenna, and the first, second, and third number of turns provides different circular polarization radiation patterns.

19. The radio front-end module of claim 17, wherein the antenna processing circuit is further configured to perform at least one of:

coupling to the one or more poly spiral antennas for multiple input multiple output (MIMO) communications;

coupling to the one or more poly spiral antennas to provide a diversity antenna; and coupling to the one or more poly spiral antennas for diversity antennas for MIMO communications.

20. The radio front-end module of claim 17, wherein at least one of the first spiral antenna section, the second spiral antenna section, and the third spiral antenna section are formed on a semi-conductive substrate.

* * * * *